US006733262B1

(12) United States Patent
Denkins

(10) Patent No.: US 6,733,262 B1
(45) Date of Patent: May 11, 2004

(54) DRYWALL HEAD WITH TAPERED CHANNEL

(75) Inventor: Jeffrey L. Denkins, Kaukauna, WI (US)

(73) Assignee: APLA-Tech, Inc., Kaukauna, WI (US)

( * ) Notice: Subject to any disclaimer, the term of this patent is extended or adjusted under 35 U.S.C. 154(b) by 218 days.

(21) Appl. No.: 10/027,336

(22) Filed: Dec. 20, 2001

(51) Int. Cl.[7] ..... B05C 17/10
(52) U.S. Cl. ..... 425/87; 425/458; 15/235.7
(58) Field of Search ..... 425/87, 458; 15/235.7, 15/235.8

(56) References Cited

U.S. PATENT DOCUMENTS 4,032,283 A 6/1977 Johnson et al. ..... 425/458
4,451,223 A 5/1984 Mower et al. ..... 425/458
4,804,321 A * 2/1989 Riesgo ..... 425/87
5,368,461 A 11/1994 Murphy ..... 425/87
5,792,489 A * 8/1998 Liberman ..... 425/458
6,155,809 A * 12/2000 Edwards et al. ..... 425/87

* cited by examiner

*Primary Examiner*—Robert Davis
*Assistant Examiner*—Thu Khanh T. Nguyen
(74) *Attorney, Agent, or Firm*—Andrus, Sceales, Starke & Sawall, LLP

(57) ABSTRACT

A drywall head for applying mastic compound or other similar material to an outside corner edge of two adjoining drywall board sections to cement on a taped-on corner during drywall assembly. The drywall head includes uniquely constructed flow channels that taper from the leading edge of the tool to the trailing edge of the tool. These uniquely constructed flow channels allow the tool to be used in a uni-directional motion.

21 Claims, 2 Drawing Sheets

DRYWALL HEAD WITH TAPERED CHANNEL

BACKGROUND OF THE INVENTION

The present invention relates to a corner tool for applying mastic material, compound, or other similar material to an external corner formed by the intersection of two sections of drywall which come together at substantially right angles, and are universally used in interior building walls.

Drywall heads for applying mastic compound to unfinished drywall corners are well known in the art. In one outside corner finishing method, a metal corner bead is secured to the outside corner edge of two adjoining drywall board sections using nails and/or screws after which a finishing coat of mastic or plaster material is applied to the outside corner. Many tools have been developed for the application of mastic material to outside corners, particularly outside corners which have been prefitted with a metal corner bead.

In a second outside corner finishing method, a first layer of fast set compound or mastic material is applied to the outside corner edge of two adjoining drywall board sections. An unfinished outside corner bead of metal, plastic, or other conventional material, is then applied to the fast set compound or mastic material contained on the outside corner edge of the adjoining drywall board sections. The unfinished corner bead preferably has a sheet of paper material adhered to the outer surface thereof. Such corner beads are generally referred to in the art as "taped-on corners". The paper material extends a short distance beyond the vertical side edges of the unfinished corner bead such that the paper overlaps the adjacent portion of the drywall board section. An outside corner finishing tool is then used to apply a layer of mastic material to both sidewalls of the outside corner to bond the outside corner edge of the drywall and the taped-on corner.

U.S. Pat. No. 5,368,461 to Murphy is directed to an outside corner finishing tool for applying mastic, compound, or plaster material to outside corner edges formed by drywall board sections. The tool is a generally polygonal block-like enclosure of rigid material including a top wall and a bottom wall, a pair of concave inward front walls defining a 90° inner corner adapted to fit an outside corner, and a back wall spaced from the front walls by a pair of spaced sidewalls. The back wall contains a spherical cavity for,receiving a ball socket connector. The cavity is connected to vertically oriented channels in the front wall. A pump-type applicator is connected to the ball socket connector and is operated to direct a regulated flow of mastic material into the spherical cavity. In turn, the mastic material is directed through the manifold to the vertical channels of the front walls for simultaneous application of mastic material along two adjoining wall board sections.

The finishing tool described in Murphy '461 patent includes vertically oriented channels that extend between the top wall and the bottom wall of the tool. The channel members have a uniform width so that the tool may be moved in either vertical direction on the outside corner of the drywall to which the material is to be applied. Thus, the channels allow the tool to be moved bi-directionally, up and down, along the outside corner of the walls without removing the tool from contact with the wall as the mastic material is applied.

As shown in the Murphy '461 patent, each channel has a uniform width throughout. In operation, mastic material enters the spherical cavity and is directed through each port into its respective dispersing cavity where it is then fed into the channels. The uniform width of the channels permit the tool to be moved in either direction, up and down, along the outside corner and thus permits the tool to be moved bi-directionally on the outside corner of the wall as the mastic material is applied.

Although the finishing tool described in the Murphy '461 patent functions reasonably well to apply a strip of mastic material, the finishing tool suffers from several drawbacks. One of these drawbacks is the removable mounting of the head on to the ball joint connector. During use of the applicator head, the ball joint connector can become disconnected from the tool head if the tool head becomes snagged on the drywall as the tool head is applying mastic material. Further, the uniform width of the vertically oriented channels restricts the ability of the tool head to be used to smooth but a section of mastic material after the mastic material has been applied. In many situations, the viscosity of the material causes the strip to expand slightly after it has been applied. If the finishing tool of the Murphy '461 patent is used to go over a strip of previously applied mastic material, the uniform channel may cause the strip to contact the other walls that define the channel and make a mess along the wall.

It is an object of the present invention to provide a drywall head for applying a metered amount of continuous, uniform and void-free mastic compound in ribbon form to adjacent walls of an unfinished corner to cement a variety of commonly used taped-on corners to an outside corner in a simple and efficient manner. It is a further object of the present invention to achieve this efficiency through the use of tapered flow channels within the inner walls of the tool. The channels taper from a leading edge of the tool to a trailing edge of the tool such that the tool is designed to be moved in a single direction along the corner. The taper of each channel allows the drywall head to gather and redistribute the strip of mastic compound on the drywall.

It is another object of the present invention to provide a drywall head for applying mastic compound of the type described which may be used with a pneumatic applicator for providing a constant and controllable flow of mastic material to the tool for application on the outside corner. When the present invention is utilized with the pneumatic applicator, a constant flow of material is supplied to the drywall head so that the material may be applied uniformly and in a constant manner to the outside corner. Use of the drywall head with the pneumatic applicator also reduces the labor effort required to apply the mastic material as physical pressure by the user is not relied upon. Furthermore, the combination of the drywall head with the pneumatic applicator allows for the one time, uni-directional application of mastic material to the unfinished corner.

SUMMARY OF THE INVENTION

The present invention is a drywall head for applying mastic compound to the adjacent walls of an unfinished corner. The drywall head is constructed of rigid material and comprises a block structure that has two inner guide surfaces set at a generally 90° angle to each other, a top surface, a bottom surface, a back wall surface, an interposed flow chamber situated within the drywall head, and a ball socket. The ball socket opens into the interposed flow chamber, and the flow chamber further opens into ports within each inner guide surface. The ports within the inner guide surfaces open into uniquely constructed flow channels. The flow channels extend between a leading edge adjacent to the bottom surface of the tool, and a trailing edge adjacent to the top surface of the tool. The flow channels are defined laterally by a pair of retaining walls. The width of each of the flow channels at the leading edge is greater than the width of the channels at the trailing edge, as the retaining walls of each channel taper from the leading edge to the trailing edge. The trailing edge of each flow channel further contains a plurality of staggered teeth situated within the flow channel to aid in the uniform deposition of a metered amount of mastic material onto the unfinished corner, thereby providing an adequate amount of mastic to prevent blistering and create a void-free strip.

The drywall head of the invention further includes a ball assembly designed to fit into the ball socket located on the back wall surface. The ball assembly allows for pivotal movement of the drywall head in relation to a delivery tool, preferably a pneumatic applicator. The invention is designed so that the tool is used in a uni-directional motion. Application of the mastic material begins when the tool is placed at the juncture of the wall corner, typically near the ceiling. Application of the mastic material continues in one direction down the outside corner to the intersection of the wall corner and the floor.

The drywall head of the invention includes a C-spring assembly that provides a resilient means for biasing the drywall head in an upright, operating position relative to the pneumatic applicator that supplies a mastic material to the drywall head. The C-spring assembly orients the drywall head at a known position such that when the drywall head is removed from the corner, the drywall head returns to a known position. Further, the combination of the C-spring assembly and a series of guide wheels allow the drywall head to flex and follow the contour of the drywall as the mastic material is applied.

The outside corner head is designed to be used in one direction due to the difference in width of the channel from the leading edge to the trailing edge. If the tool were used in the opposite direction, the previously applied strip of mastic material would enter the head at the narrower trailing edge at exit at the wider leading edge. Thus, going over a previously applied mastic strip with the drywall head oriented in an opposite direction will result in destruction of the strip and a non-uniform width due to the increase in size of the channel.

Various other features, objects and advantages of the invention will be made apparent from the following description taken together with the drawings.

BRIEF DESCRIPTION OF 1HE DRAWINGS

The drawings illustrate the best mode presently contemplated of carrying out the invention.

DETAILED DESCRIPTION OF THE INVENTION

Figure 1:
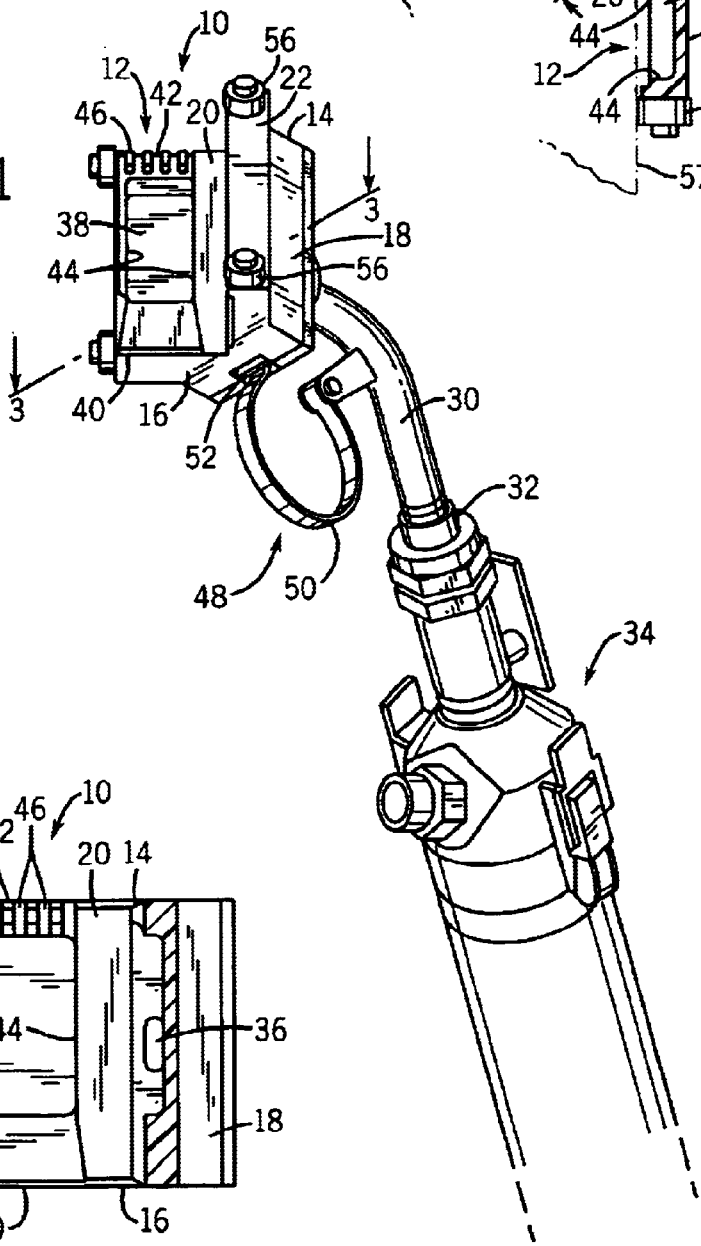
FIG. 1 is a perspective view of a drywall head with tapered channels in combination with a pneumatic applicator for use in the application of mastic material to an external corner formed by the intersection of two sections of drywall.

FIG. 1 generally illustrate a dry all head 10 with tapered applicator channels 12 that forms the basis of the present invention. The drywall head 10 is formed from an integral one-piece block of rigid material. The drywall head contains a top surface 14, a bottom surface 16, a back wall surface 18, two side surfaces 22, and two inner guide surfaces 20 set at a 90° angle to each other. The inner guide surfaces 20 are set at the 90° angle so that the tool may be placed on an external corner formed by the intersection of two sections of drywall that come together at substantially right angles, and which are universally used in interior building walls.

Figure 3:
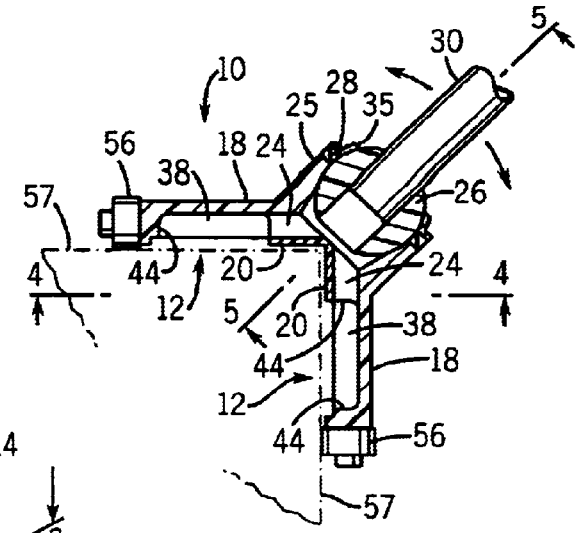
FIG. 3 is a section view taken along line 3—3 of FIG. 1.

As can be seen in FIG. 3, the drywall had 10 includes a flow chamber 24 that is situated within the surfaces of the drywall head 10. The back wall 18 includes a mounting portion 25 that defines spherical cavity or ball socket 28 designed for receiving a ball assembly. The ball assembly consists of a ball member 26 designed to fit into the ball socket 28, an arm member 30, and a coupling member 32, as shown in FIG. 1. The arm member 30 includes a hollow interior that allows material to be moved from the applicator 34 to the drywall head 10. The arm member 30 is curved so that the drywall head 10 may be parallel to the wall surfaces while a user is holding the pneumatic applicator 34 at an angle to the wall and drywall head 10. The coupling member 32 is designed to attach the drywall head 10 to the pneumatic applicator 34.

Figure 4:
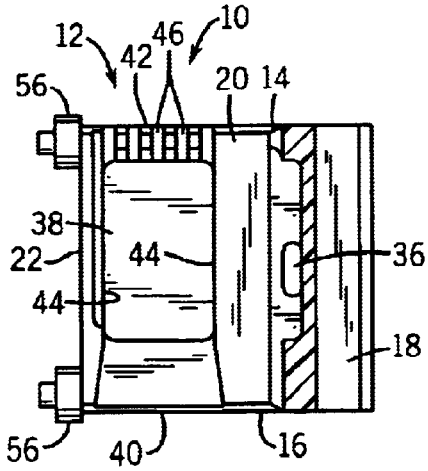
FIG. 4 is a section view taken along line 4—4 of FIG. 3.

As best seen in FIG. 4, each of the inner guide surfaces 20 of the drywall head 10 include a tapered channel 12 extending from a leading edge 40 to a trailing edge 42. The width of the tapered channel 12 is defined by a pair of retaining walls 44. The width between the retaining walls 44 at the leading edge 40 is greater than the width between the retaining walls 44 at the trailing edge 42, thus creating a flow channel that tapers from the leading edge 40 to the trailing edge 42.

The tapered channels 12 are each designed such that the volume of mastic material that enters at the leading edge 40 is greater than the volume of mastic compound deposited on the wall at the trailing edge 42. In the present invention, the increase in volume at the leading edge 40 is due primarily to the greater width of the channel 12 at the leading edge 40 compared to the width of the channel 12 at the trailing edge 42. However, it is also contemplated by the inventor that the depth of the tapered channel could be greater at the leading edge 40 as compared to the trailing edge 42 to further aid in gathering and redistributing the mastic compound. The tapered flow channels 12 contain a number of protruding teeth 46 located at the trailing edge 42 for the purpose of profiling the strip and metering the amount of mastic compound applied.

Referring back to FIG. 3, the flow chambers 24 connect the ball socket 28 to the cavity 38 formed in each of the tapered channels 12. Specifically, the interposed flow chambers 24 are situated entirely within the drywall head 10 and branch into each of the respective cavities 38. As shown in FIG. 4, each branch of the flow chambers 24 includes a port 36 that feeds into a cavity 38 set between the inner retaining walls 44 of each tapered channel 12.

Figure 5:
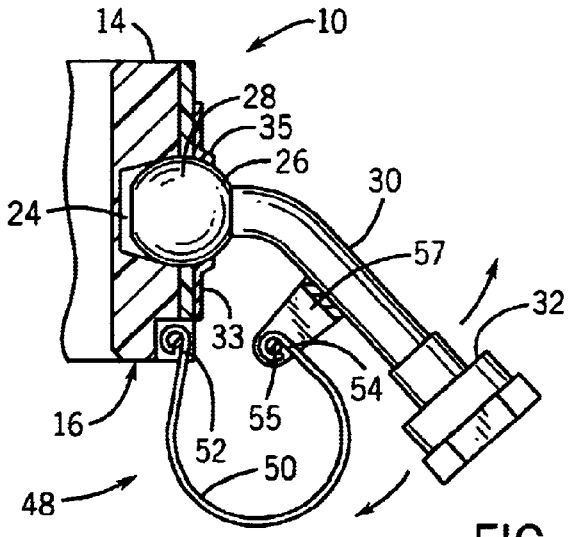
FIG. 5 is a section view taken along line 5—5 of FIG. 3.

When the ball member 26 is placed within the ball socket 28, the ball member 26 is retained within the ball socket 28 by a retaining bracket 33 including an extended flange 35, as best seen in FIG. 5. The retaining bracket 35 allows the drywall head 10 to move pivotally in relation to the pneumatic delivery tool 34. However, too much play in the pivotal movement of the drywall head 10 creates difficulty in controlling the drywall head 10 during application of mastic compound to unfinished drywall corners. To restrict such movement, a C-spring assembly 48 is employed to facilitate control of the drywall head 10 during application of mastic compound.

As shown in FIG. 5, the C-spring assembly 48 consists of a C-spring 50 that is attached to the back wall 18 of the drywall head 10 at a first end 52. A second end 54 of the C-spring 50 is attached to a pin 55 positioned between a pair of brackets 57 mounted to the arm member 30 of the ball assembly. The means for attaching the C-spring 50 to the drywall head 10 and the arm member 30, respectively, may be achieved in many different ways, all well known within the art.

During operation of the pneumatics applicator 34 and the drywall head 10, the C-spring 50 biases the drywall head 10 into a known orientation, as illustrated in FIG. 1. Thus, when the drywall head 10 is removed from the corner, the drywall head 10 returns to the position shown in FIG. 1. Further, the C-spring 50 holds the drywall head 10 in position as the drywall head 10 is moved into contact with the corner. The bias force created by the C-spring 50 allows accurate placement of the drywall head on the corner by a user.

During application of the mastic material to the corner, the C-spring 50 flexes, which allows the angle between the pneumatic applicator 34 and the drywall head 10 to vary to allow for smooth application of the mastic material to the drywall. Thus, the C-spring assembly 48 in combination with the ball member 26 allows the drywall head 10 to move relative to the arm member 30 while returning the drywall head 10 to a known, biased position.

Referring now to the FIGS. 1 and 3, the drywall head 10 includes a pair of guide wheels 56 mounted to each of the side surfaces 22. As illustrated in FIG. 3, the guide wheels 56 contact the face surface 57 of the drywall and allow the drywall head 10 to move smoothly along the drywall during application of the mastic material, thus preventing wear on the block, which would affect the amount of material being applied.

It is also possible to place a removable bull nose centering block (not shown) at the intersection of the inner walls 20. Such bull nose centering block would be used when applying mastic compound to a drywall corner that is formed by a pair of walls that do not extend to the apex of the corner. The removable bull nose centering block would prevent flow of mastic compound into such an unfinished corner.

In operation, the pneumatic delivery tool 34 pushes mastic material through the arm member 30 and the ball member 26 into the ball socket 28, as illustrated in FIG. 3. The mastic material disperses into the interposed flow channels 24, which subsequently feeds the mastic material equally through each port 36 into the tapered flow channels 12. As the mastic material enters the tapered flow channels 12 from the ports 36, the mastic material accumulates in the cavity 38.

The drywall head 10 is placed flush onto the wall corner at the juncture of the wall corner and the ceiling. As the mastic material fills the cavity 38, it is dispersed within the tapered flow channel 12. At the same time, the user will begin to direct the drywall head along the outside corner of the wall, in a unidirectional motion, so that the mastic material is deposited along the outside corner in two strips which are spaced at a distance from the apex of the outside corner. The unique construction of the tapered flow channel 12 requires that the drywall head 10 to move along the corner in only one direction due to the difference in width of the flow channel 12 from the leading edge 40 to the trailing edge 42. The flow of mastic material from the cavity 38 exits the tool through the staggered teeth 46 of the trailing edge 42. Significantly, the staggered teeth 46 located within the tapered channel 12 help disperse the mastic material evenly as it flow out of the drywall head 10 at the trailing edge 42. Thus, the mastic material exits the drywall head 10 at the trailing edge 42 in an evenly dispersed strip of a volume adequate to provide a void-free band without excess wasted material.

After the initial strip of mastic material has been applied to the corner, the orientation of the drywall head 10 can be rotated 180° and additional mastic material can be applied or the drywall head 10 can be used to further smooth the mastic material already applied. Specifically, the leading edge 40 is wider than the strip of material applied to the wall, such that the leading edge 40 can gather the strip even if the strip has expanded in width due to the viscosity of the material. Thus, it is important that the drywall head 10 be moved in the direction that permits the leading edge 40 to contact the already applied mastic material before the trailing edge 42.

As can be understood from FIGS. 1 and 4, the drywall head 10 is designed to be used in one direction due to the difference in width of the flow channels 12 from the leading edge 40 to the trailing edge 42. If the tool were used in the opposite direction, i.e. if the trailing edge 42 lead the tool up the wall instead of following it down, the previously applied strip of mastic material would enter the drywall head 10 at the narrower trailing edge 42 and exit at the wider leading edge 40. Thus, going over a previously applied strip of mastic material would result in destruction of the strip.

Figure 2:
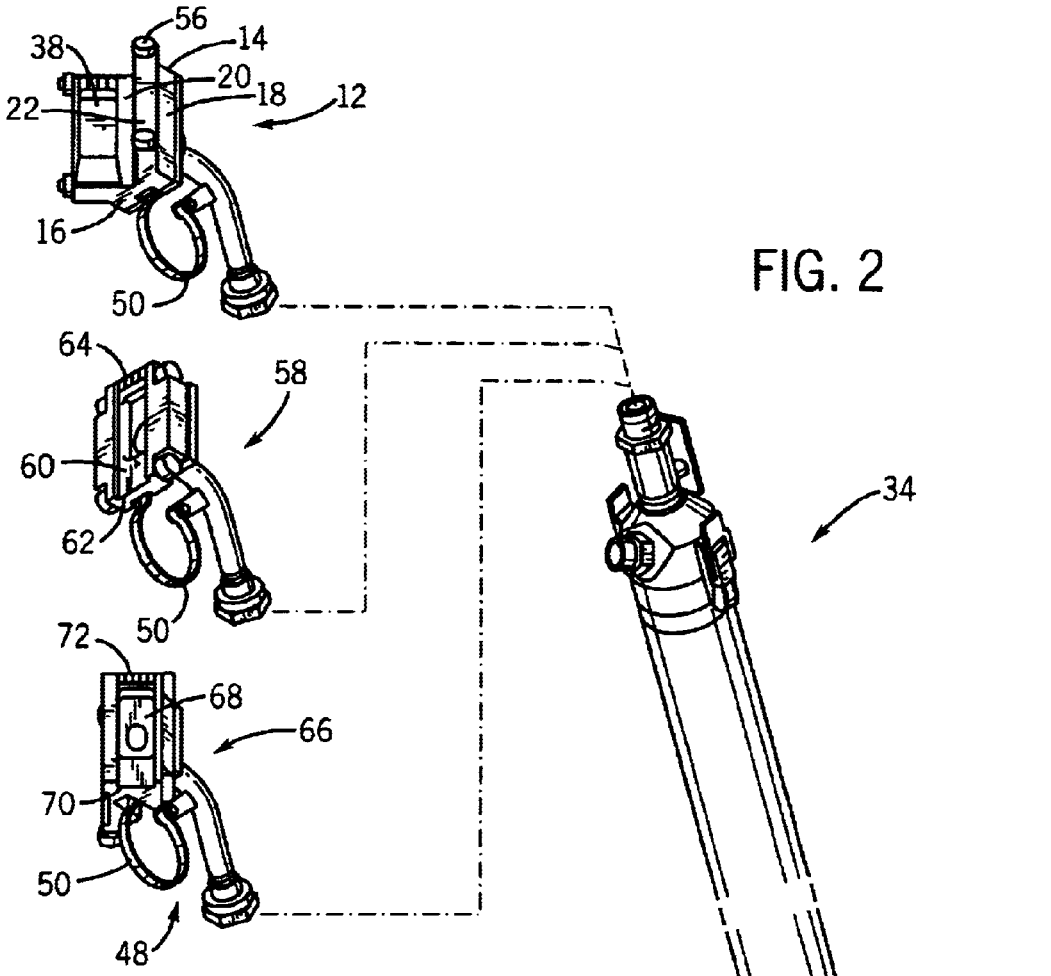
FIG. 2 is a perspective view demonstrating the interchangeability of the invention with different heads on a pneumatic applicator.

Referring now to FIG. 2, thereshown are alternate types of the drywall head 10 being contemplated as being within the scope of the present invention. FIG. 2 illustrates a mastic strip applicator 58 that is used to apply a single strip of mastic material anywhere along a drywall surface. As is illustrated in FIG. 2, the strip applicator 58 includes a single channel 60 that has a leading edge 62 and a trailing edge 64. The leading edge 62 of the strip applicator 58 is volumetrically larger than the trailing edge 64 such that the strip applicator 58 is also used in only one direction. The remaining components of the strip applicator 58, including the C-spring 50, are identical to those included in the drywall head 10 previously discussed.

Also shown in FIG. 2 is an inside corner drywall head 66 that is used to apply two strips of mastic material to an inside corner formed by two sections of drywall. The inside corner head 66 also includes a pair of flow channels 68 each defined by a leading edge 70 and a trailing edge 72. Once again, the leading edge 70 is volumetrically larger than the trailing edge 72 such that the inside corner head 66 is designed to be used in only one direction. The inside corner head 66 operates in a nearly identical manner to the outside drywall head 10 previously described. Additionally, the inside corner head also includes the C-spring assembly 48 used to bias the finishing head in a known position.

It is understood that the dimensions for the width of the tapered channel at the leading edge, the width of the tapered channel at the trailing edge, the depth of the cavity, and the spacing of the channels from the corner apex may be varied as desired for use with the size of the taped-on corner being utilized. Likewise, it is understood that the materials of construction for the drywall head 10 may include a variety of materials including, but not limited to, metal, hard plastic, or wood.

Various alternatives and embodiments are contemplated as being within the scope of the following claims particularly pointing out and distinctly claiming the subject matter regarded as the invention.

I claim:

1. A drywall head for applying mastic compound to the adjacent walls of an unfinished corner, the drywall head being constructed of rigid material and comprising two guide surfaces set at generally 90° angles to each other, a top surface, a bottom surface, two side surfaces, a back wall surface, and an interposed flow chamber situated within the drywall head to receive the supply of mastic compound, the drywall head comprising;

a tapered flow channel formed in each of the guide surfaces, each tapered flow channel being recessed from the guide surface and extending from the bottom surface of the drywall head to the top surface of the drywall head, each tapered flow channel being in communication with the flow chamber, said flow channels each including a leading edge intersecting the bottom surface, a trailing edge intersecting the top surface, and a pair of retaining walls that define the width of the flow channel;

wherein the width of each flow channel at the leading edge is greater than the width of the flow channel at the trailing edge.

2. The drywall head of claim 1 wherein the drywall head contains a non-detachable ball assembly, the ball assembly designed to fit into a ball socket located in the back wall surface of the drywall head, the ball socket opening into the flow chamber, said ball assembly comprising a ball member and an arm member.

3. The drywall head of claim 2 further comprising a C-spring assembly positioned to bias the drywall head into an application position, the C-spring assembly including a C-spring attached to the back wall of the drywall head at a first end and attached to the arm member of the ball assembly at a second end.

4. The drywall head of claim 1 wherein each of the sidewalls contain a pair of guide wheels to guide the drywall head along a wall corner.

5. The drywall head of claim 1 further comprising a plurality of spaced teeth positioned within the flow channel at the trailing edge of the flow channel.

6. The drywall head of claim 1 wherein the pair of flow channels are parallel to each other.

7. The drywall head on claim 1 wherein the volume of the flow channel at the leading edge is greater than the volume of the trailing edge.

8. A drywall head for applying mastic compound or other similar material to an outside corner edge of two adjoining drywall board sections to secure a tape-on corner, said drywall head being constructed of rigid material and having a pair of inner walls defining a generally 90° inside corner, a pair of sidewalls, a back wall, spaced from the inner walls by the sidewalls, a top wall, and a bottom wall, the drywall head comprising:

a flow chamber interposed between the walls of the drywall head, the flow chamber positioned to receive the supply of mastic compound; and a tapered flow channel recessed within each of the inner walls of the drywall head, wherein each flow channel is in communication with the flow chamber, each flow channel extending between a leading edge intersecting the bottom wall of the drywall head and, a trailing edge intersecting the top wall of the drywall head, each flow channel further including a pair of retaining walls that define the width of the flow channel;

wherein the width of the flow channel at the leading edge is greater than the width of the flow channel at the trailing edge, and the trailing edge contains a plurality of spaced teeth at the trailing edge.

9. A drywall head for applying mastic compound or other similar material to an outside corner edge of two adjoining drywall board sections to secure a tape-on corner, said drywall head being constructed of rigid material and having a pair of inner walls defining a generally 90° inside corner, a pair of sidewalls, a back wall spaced from the inner walls by the sidewalls, a top wall, and a bottom wall, the drywall head comprising:

a non-removable ball assembly attached to the back wall of the drywall head by closely fitting the ball assembly into a ball socket located within the back wall of the drywall head, the ball assembly for directing the flow of mastic compound into the flow chamber from a delivery tool, wherein the ball assembly allows for pivotal movement of the drywall head in relation to the delivery tool;

a C-spring attached to the back wall of the drywall head at a first end and attached to an arm member of the ball assembly at a second end, wherein the C-spring restricts the pivotal movement of the drywall head;

a flow chamber interposed between the walls of the drywall head, the flow chamber positioned to receive the supply of mastic compound; and a tapered flow channel situated within each of the inner walls of the drywall head, wherein each flow channel is in communication with the flow chamber, each flow channel including a leading edge, a trailing edge, and a pair of retaining walls that define the width of the flow channel;

wherein the width of the flow channel at the leading edge is greater than the width of the flow channel at the trailing edge, and the trailing edge contains a plurality of spaced teeth at the trailing edge.

10. The drywall head of claim 9 wherein each of the sidewalls contains a pair of guide wheels to guide the drywall head along a wall corner.

11. The drywall head of claim 9 further comprising a removable bull nose centering block positionable at the intersection of the inner walls to prevent flow of mastic compound into an unfinished corner.

12. A drywall head for applying mastic compound to adjacent walls of an unfinished corner, the drywall head being constructed of a rigid material and for use with a mastic delivery tool, the drywall head comprising:

a top surface;

a bottom surface;

a pair of inner walls defining a 90° inside corner;

a pair of sidewalls;

a back surface spaced from the inner walls by the sidewalls;

a flow chamber formed in the drywall head;

a ball socket located within the back wall and in communication with the flow chamber;

a pair of ports connecting the flow chamber to a pair of flow channels each situated within one of the inner walls, each of the flow channels extending from the top surface of the drywall head to the bottom surface of the drywall head, each flow channel comprising:

a leading edge intersecting the bottom surface of the drywall head;

a trailing edge intersecting the top surface of the drywall head; and a pair of retaining walls that define the width of the flow channel;

wherein the trailing edge contains a plurality of spaced teeth situated within the channel and the width of the channel at the leading edge is greater than the width of the channel at the trailing edge.

13. The drywall head of claim 12 wherein a ball assembly is attached to the back wall by closely fitting the assembly into the ball socket, the ball assembly comprising a ball member jointed to an arm member.

14. The drywall head of claim 13 wherein the ball assembly allows for pivotal movement of the drywall head in relation to the delivery tool.

15. The drywall head of claim 14 further comprising a C-spring attached to the back wall of the drywall head at a first end and attached to the arm member of the ball assembly at a second end, wherein the C-spring restricts the pivotal movement at the drywall head.

16. The drywall head of claim 12 wherein each sidewalls contains a pair of guide wheels to guide the drywall head along a wall corner.

17. The drywall head of claim 12 wherein a removable bull nose centering block having a generally rectangular shape may be placed at the intersection of the inner walls to prevent flow of mastic compound into an unfinished corner.

18. The drywall head on claim 12 wherein the volume of the flow channel at the leading edge is greater than the volume of the trailing edge.

19. In a drywall head for use with a mastic delivery tool for applying at least one uniform strip of mastic compound to a section of drywall, the drywall head being constructed of rigid material and including at least one inner wall including a flow channel for applying the strip of mastic material to the section of drywall and a back wall spaced from the inner wall by a pair of sidewalls, the improvement comprising:

a non-removable ball assembly attached to the back wall of the drywall head by fitting the ball assembly into a ball socket located within the back wall of the drywall head, the ball assembly for directing the flow of mastic compound into the flow chamber from the delivery tool, wherein the ball assembly allows for pivotal movement of the drywall head in relation to the delivery tool, the ball assembly comprising a ball member positioned within the ball socket and an arm member for receiving the flow of mastic compound from the mastic delivery tool; and a bias member positioned between the drywall head and the ball assembly for restricting the pivotal movement of the drywall head relative to the mastic delivery tool, wherein the bias member includes a C-spring having a first end attached to the back wall of the drywall head and a second end attached to the arm member of the ball assembly, wherein the C-spring restricts the pivotal movement of the drywall head and biases the drywall head into an application position.

20. The improvement of claim 19 wherein the flow channel extends between a leading edge and a trailing edge and has a width defined by a pair of retaining walls, wherein the width of the flow channel at the leading edge is greater than the width of the flow channel at the trailing edge.

21. The improvement of claim 20 wherein the trailing edge of the flow channel includes a plurality of spaced teeth.

* * * * *